US007704452B2

(12) United States Patent
Prengaman et al.

(10) Patent No.: US 7,704,452 B2
(45) Date of Patent: Apr. 27, 2010

(54) ALLOY AND ANODE FOR USE IN THE ELECTROWINNING OF METALS

(75) Inventors: David R. Prengaman, Arlington, TX (US); Andreas Siegmund, Lantana, TX (US)

(73) Assignee: RSR Technologies, Inc., Dallas, TX (US)

( * ) Notice: Subject to any disclaimer, the term of this patent is extended or adjusted under 35 U.S.C. 154(b) by 1039 days.

(21) Appl. No.: 11/361,146

(22) Filed: Feb. 23, 2006

(65) Prior Publication Data

US 2007/0193879 A1 Aug. 23, 2007

(51) Int. Cl.
*C22C 11/02* (2006.01)
*C22C 11/06* (2006.01)

(52) U.S. Cl. ..... 420/565; 420/563; 420/564; 420/570; 205/575; 205/576; 205/578; 205/579; 204/293

(58) Field of Classification Search ..... 420/563, 420/564, 565, 570; 205/575, 576, 578, 579; 204/293; 252/512, 513, 520.1
See application file for complete search history.

(56) References Cited

U.S. PATENT DOCUMENTS 4,358,518 A * 11/1982 Matter ..... 429/245
4,789,607 A * 12/1988 Fujita et al. ..... 428/653
5,298,350 A * 3/1994 Rao ..... 429/245
5,434,025 A * 7/1995 Rao et al. ..... 429/245
5,691,087 A * 11/1997 Rao et al. ..... 429/245
5,834,141 A * 11/1998 Anderson et al. ..... 429/245
5,948,566 A * 9/1999 Larsen et al. ..... 429/225
6,649,306 B2 * 11/2003 Prengaman ..... 429/245
6,699,620 B2 * 3/2004 Zhang et al. ..... 429/245
2001/0009743 A1 * 7/2001 Prengaman ..... 429/245
2002/0090554 A1 * 7/2002 Chen ..... 429/241
2003/0017399 A1 * 1/2003 Zhang et al. ..... 429/245
2005/0150092 A1 * 7/2005 Chen ..... 29/2

* cited by examiner

*Primary Examiner*—Bruce F Bell
(74) *Attorney, Agent, or Firm*—Howrey LLP

(57) ABSTRACT

A lead calcium tin alloy to which cobalt has been added is described. The alloy is useful in the formation of anodes to be used in electrowinning cells. Electrowinning cells containing the cobalt alloys are particularly suited for electrowinning metals, such as copper, from sulfuric acid electrolytes. The cobalt-containing anodes improve the efficiency of oxygen evolution at the anode during electrowinning and reduce corrosion of the anode.

17 Claims, No Drawings

ALLOY AND ANODE FOR USE IN THE ELECTROWINNING OF METALS

CROSS-REFERENCE TO RELATED APPLICATIONS

Not applicable

STATEMENT REGARDING FEDERALLY SPONSORED RESEARCH OR DEVELOPMENT

Not applicable

BACKGROUND OF THE INVENTION

Lead calcium tin alloys have been used as electrowinning anodes for copper electrowinning for many years. Prengaman et al. in U.S. Pat. No. 4,373,654 developed the first rolled lead calcium tin anode. These anodes have been used in copper electrowinning service since the early 1980's. The anodes utilizing rolled lead calcium tin alloys have a long life. The combination of calcium and tin content along with mechanical working produced a material with high mechanical strength to prevent distortion, warping and short circuits while in service. The combination of tin and calcium reduces the rate of corrosion, promotes the formation of a conductive corrosion layer on the anode surface and improves the stability of the anode leading to improved anode life. Improvements have been made by Prengaman in the attachment of rolled alloy sheets to the copper bus bar in U.S. Pat. No. 6,131,798. In Prengaman et al. U.S. Pat. No. 5,172,850, the copper bus bar is protected from attack by coating it with a layer of electro-deposited lead onto the copper bus bar, thus improving the resistance to acid.

Despite the improvements in life in the copper electrowinning anodes, the anodes are corroded by the oxygen generated in the electrowinning process. Prengaman in "Improved Copper Electrowinning Operations Using Wrought Pb, Ca, Sn Anodes," Cu 99 International Symposium, October 1999, describes the anode corrosion. Oxygen is either evolved as oxygen gas or diffuses through the corrosion product on the surface of the anode to the lead surface where it reacts with the lead alloy to corrode the anode. It is important to produce a complete uniform, compact, thin, adherent and conductive $PbO_2$ corrosion layer on the surface of the anode so that the oxygen can be evolved efficiently.

As the corrosion product becomes thicker, it begins to develop small cracks parallel to the anode surface. These cracks eventually result in the production of non-adherent flakes on the surface of the anode. The corrosion product can then be dislodged from the surface by the bubbles of oxygen generated at the anode surface. If the flakes contact the cathode, they can be reduced to metallic lead and become entrained in the cathode.

The rate of corrosion is related to the electrolyte temperature and current density of the electrowinning cell. The higher the current density and the higher the temperature, the more rapid is the rate of corrosion. In addition to the electrowinning cell conditions, the electrolyte often contains manganese. Manganese can react with the $PbO_2$ corrosion product on the surface of the oxide, making it less stable and adherent and thus more susceptible to shedding. This was described by Prengaman in Cu 87 volume 3 and Electrometallurgy of copper Ed by W. Cooper, G. Loyas, G. Vearte, p. 387.

To reduce the rate of corrosion of the anode, increase the oxygen evolution and reduce the deleterious effects of the manganese, cobalt has been added to copper electrowinning electrolytes. Cobalt addition to electrowinning solutions was first described by O. Hyvarinen, P&D thesis 1971 and more recently by Yu and O'Keefe in J. Electrochem Society 146 (4) 1999, p. 1361, "Evolution of Lead Anode Reactions in Acid Sulfate Electrolytes I. Lead Anodes with Cobalt Additives."

The cobalt depolarizes the oxygen evolution reaction leading to easier oxygen evolution. This results in reduced anode corrosion, improved copper cathode quality and longer anode life. Cobalt ions are absorbed onto the lead corrosion product. Analysis of the corrosion product shows the presence of cobalt.

Cobalt is added to the electrolyte in an amount of generally 50-300 ppm. Jenkins et al., in copper 99 Vol. IV Hydrometallurgy of Copper Electrolyte Copper-Leach, Solvent Extraction and Electrowinning World Operation Data, surveys the operating conditions from 34 copper electrowinning tankhouses. To maintain the cobalt content of the electrolyte, cobalt must be continuously added to make up for the bleed of electrolyte from this system to control the impurities in the electrolyte. The cobalt addition varies from 100-800 g per ton of copper cathode. Loss of cobalt in the bleed is a major cost in operating copper tankhouse.

BRIEF SUMMARY OF THE INVENTION

This invention relates to lead alloys suitable for anodes used in electrowinning metals, particularly copper, from sulfuric acid solutions. The invention involves addition of cobalt to a conventional lead calcium tin alloy that is used for anodes for electrowinning metals. The alloy may also contain strontium, barium, silver and/or aluminum and is preferably rolled. When applied to an electrowinning cell, the anode produces a lower oxygen overvoltage compared to similar anodes made from alloys that do not contain cobalt. The invention relates to the alloy, the anode, the cell and the method of electrowinning using a cell containing the anode.

DETAILED DESCRIPTION OF THE INVENTION

The present invention provides an alloy suitable for use as an anode for electrowinning metals. In accordance with the invention cobalt is added to a lead tin calcium alloy conventionally used to form anodes. The alloy may contain barium or strontium in lieu of or in addition to the calcium. In addition, silver or aluminum may be present. The alloy may also contain trace amounts of materials present in recycled lead.

More specifically, the alloy is a lead alloy containing 0.03-0.10% calcium, 0.5-2.5% tin and 0.005-0.300% cobalt. It is to be understood that all percentages herein refer to weight percentages. It is most preferred that the tin to calcium ratio be at least 14:1.

The amount of calcium in the alloy is preferably at least 0.05%. It is also preferable that the calcium not exceed 0.08%.

With respect to the tin, it is preferable that the alloy contain at least 1.0%. It is also preferable that the tin not exceed 2.2%.

The cobalt is desirably at least 0.005% of the alloy, and more preferably at least 0.01% of the alloy. The upper limit of cobalt in the alloy is desirably no more than 0.100%, and more preferably no more than 0.040%.

A particularly preferred lead alloy of the present invention will contain 0.05 to 0.08% calcium, 1.0 to 2.2% tin and 0.005 to 0.100%, more preferably 0.005 to 0.040% cobalt.

The alloy may additionally contain aluminum in an amount of 0.001-0.035%. The aluminum prevents oxidation of the calcium during processing. Preferably the aluminum does not exceed 0.008%.

The alloy of the invention may also contain 0.002-0.10% silver, more preferably 0.002 to 0.080% silver. The silver reduces corrosion, adds mechanical properties and makes the anode more resistant to structural change at elevated temperatures. As the current density in copper electrowinning is increased, an increase in the operating temperature of the electrolyte promotes improved deposition conditions for the cathode. Higher temperatures increase the rate of corrosion of lead anode and higher temperatures increases the chance of recrystallization or structure changes in the anode material which can increase corrosion. Recrystallization also results in loss of mechanical properties. Silver additions restrict grain boundary movement, maintain mechanical properties, reduce creep and structural changes in the alloy. If the silver content is not high enough, there is not sufficient silver in the material to restrict the grain boundary movement at elevated temperatures. The silver contents utilized are much lower than those of anodes used for zinc electrowinning.

The most preferred alloy of the invention is a lead alloy containing about 0.07% calcium, about 1.4% tin, about 0.015% cobalt, about 0.02% silver and about 0.008% aluminum.

The alloys of the invention may be used as anodes for electrowinning metals, such as copper, nickel or manganese. To form the anode of the invention, the alloy may be cast into a billet and deformed by rolling to at least a 1.5:1 reduction. The rolling reorients the grain structure to the rolling direction. Wrought materials have greater resistance to corrosion and casting defects than cast anodes. It is most preferred that the material be rolled to a deformation ratio of greater than 4:1.

The anodes of the invention may be used in electrowinning cells and methods. In a preferred embodiment, the invention comprises an improved electrowinning cell having an anode, a cathode and a sulfuric acid electrolyte in which the improvement comprises using the cobalt containing anode described above. The anodes of the invention may be used to effect improved electrowinning of metals, such as copper, nickel and manganese. The anodes have particular applicability to electrowinning metals in sulfuric acid electrolytes. The improved method of the invention has particular applicability to copper. The anodes of the invention exhibit more efficient oxygen evolution and consequently greater corrosion resistance.

It has been discovered that anodes containing lead, calcium, tin and cobalt or lead, calcium, tin, cobalt and silver are depolarized when corroded in a sulfuric acid electrolyte compared to the same material without cobalt. The depolarization may be 20-100 mv. It is believed that this beneficial effect is achieved when cobalt is added to lead calcium tin alloys used to form the anode because the cobalt dopes the corrosion layer. As a consequence, when the corrosion layer is created on an anode made from the alloy of the invention containing cobalt, the behavior of the anode is similar to that of a lead calcium tin anode (containing no cobalt) when it operated in an electrolyte solution containing 200 ppm cobalt. Unlike the non-cobalt containing anodes, when the anode of the invention is used there is no need to replenish cobalt in the electrolyte in order to achieve the beneficial effects of cobalt on oxygen evolution.

In addition, the corrosion product developed in the anodes containing cobalt is thinner and less subject to remission to $PbSO_4$ than the same material without cobalt. Once the corrosion layer forms, it is fully doped with cobalt. As the corrosion layer is spalled and the anode is slowly corroded, a new corrosion layer forms that is doped by the cobalt of the alloy and accordingly maintains the lower potentials for oxygen evolution.

EXAMPLE

Sample Materials

To determine the benefits of cobalt on oxygen evolution, three anode alloys were evaluated:

Sample 1: A lead alloy containing 0.078 wt % calcium, 1.35 wt % tin and 0.005 wt % aluminum and rolled to 0.250 inches thick was used as the base material for comparing the behavior of various anode alloy materials.

Sample 2: A lead alloy containing 0.058 wt % calcium, 2.0 wt % tin, 0.012 wt % silver, 0.0145 wt % cobalt, and 0.005 wt % aluminum, and was rolled to 0.250 inches thick using reduction ratio of 5:1.

Sample 3: A third alloy containing 0.059 wt % calcium, 2.15 wt % tin, 0.015 wt % cobalt and 0.062 wt % silver, and 0.005 wt % aluminum was rolled to 0.250 inches thick using reduction ratio of 5:1.

As shown below, the addition of cobalt to the anode alloy reduced the amount of corrosion and enhanced oxygen evolution efficiency.

Oxidation Evolution Testing

The three anode alloy test samples in a first group were polished and oxidized for 5 hours at 30 mA/cm$^2$ in 180 g/l $H_2SO_4$. (Electrolyte 1). Three samples in a second group were polished and oxidized for 5 hours at 30 mA/cm$^2$ in an electrolyte of 180 g/l $H_2SO_4$ containing 0.2 g/l Co (Electrolyte 2). The results of the testing are seen in Table 1.

TABLE 1

| | Anode Potential (Volts) | | |
|---|---|---|---|
| | Base Alloy 1 | Alloy 2 | Alloy 3 |
| Corrosion Test | | | |
| (1) 180 g/$H_2SO_4$ | 2.14 | 2.12 | 2.12 |
| (2) 180 g/l + 200 ppm Co | 2.05 | 2.06 | 2.06 |
| Wash & Dry | | | |
| Cycling Test | | | |
| (1) 180 g/$H_2SO_4$ | 2.13 | 2.08 | 2.03 |
| (2) 180 g/$H_2SO_4$ | 2.02 | 1.99 | 1.99 |

The samples containing cobalt showed about 20 mv depolarization during oxidation to form the corrosion layer compared to the same material without cobalt. When oxidized in a cobalt containing solution of 200 ppm cobalt (Electrolyte 2), all the samples were more highly depolarized, and no significant difference was seen between the samples.

The samples were washed and dried and then cycled in 180 g/l $H_2SO_4$ at 30 mA/cm$^2$ to determine the effects of doping of the $PbO_2$ corrosion layer by the tin, cobalt and silver which occurred during the creation of the corrosion layer. The results are shown in the wash and dry cycling test.

The baseline sample showed a reduction in potential to 2.13 v from 2.14 v. This is believed to be due to the doping of the created corrosion layer with tin. The sample 2 with cobalt addition showed a depolarization of 40 mv more than to the baseline material. Sample 3 exhibited a depolarization of 90 mv compared to the baseline material and 110 mv over the original baseline potential. The samples oxidized in the 200 ppm solution of cobalt (Electrolyte 2) showed similar polarization with the cobalt containing materials about 30 mv lower than the baseline.

The results show that the development of the corrosion layer in a solution which contains no cobalt exhibited significant depolarization of cobalt containing anodes. In the case of example 3, the depolarization was nearly the same result as development of the corrosion layer in high cobalt containing solution.

In alloys containing cobalt, the newly-formed corrosion layer was doped with cobalt and remained absorbed into the corrosion layer even after washing, drying and cycling. The amount of cobalt in the corrosion product on the surface of the anode was 25-30% lower than that of the base metal anode. The doped corrosion layer was almost as active as the corrosion layer developed from the high cobalt containing electrolyte.

As the corrosion layer is spalled, the cobalt from the alloy can continue to dope the newly formed corrosion layer, thereby providing cobalt to maintain the depolarization of the anode.

The invention claimed is:

1. A lead tin alloy containing greater than 0% of a member selected from the group consisting of calcium, barium and strontium and also containing between 0.005 and 0.300% cobalt and up to 0.035% aluminum.

2. The alloy of claim 1 containing 0.03 to 0.10% calcium, 0.5 to 2.5% tin and 0.005 to 0.300% cobalt.

3. The alloy of claim 2 containing up to 0.08% calcium, up to 2.2% tin and up to 0.1% cobalt.

4. The alloy of claim 2 containing at least 0.05% calcium, at least 1.0% tin and at least 0.01% cobalt.

5. The alloy of claim 4 containing no more than 0.04% cobalt.

6. The alloy of claim 2 which additionally comprises up to 0.1% silver.

7. The alloy of claim 6 which additionally comprises 0.001 to 0.035% aluminum.

8. The alloy of claim 1 containing 0.05 to 0.08% calcium, 1.0 to 2.2% tin and 0.01 to 0.100% cobalt.

9. The alloy of claim 8 containing 0.002 to 0.08% silver.

10. An electrowinning anode comprising a lead tin alloy containing greater than 0% of a member selected from the group consisting of calcium, barium and strontium and also containing between 0.005 and 0.300% cobalt.

11. An electrowinning anode comprising the alloy of claim 10 containing 0.03 to 0.10% calcium, 0.5 to 2.5% tin and 0.005 to 0.300% cobalt.

12. An electrowinning anode comprising the alloy of claim 10 containing 0.05 to 0.08% calcium, 1.0 to 2.2% tin and 0.01 to 0.100% cobalt.

13. An electrowinning anode comprising the alloy of claim 10 which additionally comprises up to 0.1% silver.

14. In a cell for electrowinning metals containing an anode, a cathode and an electrolyte, the improvement comprising the anode of claim 10.

15. In a method of electrowinning a metal in an electrowinning cell, the improvement comprising electrowinning the metal using the anode of claim 10.

16. The method of claim 15, wherein the electrowinning is conducted in a sulfuric acid electrolyte.

17. The method of claim 15, wherein the metal being electrowon is selected from the group consisting of copper, nickel and manganese.

* * * * *

US007704452C1

(12) EX PARTE REEXAMINATION CERTIFICATE (9738th)

United States Patent
Prengaman et al.

(10) Number: US 7,704,452 C1
(45) Certificate Issued: Jul. 8, 2013

(54) ALLOY AND ANODE FOR USE IN THE ELECTROWINNING OF METALS

(75) Inventors: David R. Prengaman, Arlington, TX (US); Andreas Siegmund, Lantana, TX (US)

(73) Assignee: RSR Technologies, Inc., Dallas, TX (US)

Reexamination Request:
No. 90/011,965, Oct. 18, 2011

Reexamination Certificate for:

| | |
|---|---|
| Patent No.: | **7,704,452** |
| Issued: | **Apr. 27, 2010** |
| Appl. No.: | **11/361,146** |
| Filed: | **Feb. 23, 2006** |

(51) Int. Cl.
*C22C 11/02* (2006.01)
*C22C 11/06* (2006.01)

(52) U.S. Cl.
USPC ..... 420/565; 420/563; 420/564; 420/570; 204/293; 205/575; 205/576; 205/578; 205/579

(58) Field of Classification Search
None
See application file for complete search history.

(56) References Cited

To view the complete listing of prior art documents cited during the proceeding for Reexamination Control Number 90/011,965, please refer to the USPTO's public Patent Application Information Retrieval (PAIR) system under the Display References tab.

*Primary Examiner* — Timothy Speer

(57) ABSTRACT

A lead calcium tin alloy to which cobalt has been added is described. The alloy is useful in the formation of anodes to be used in electrowinning cells. Electrowinning cells containing the cobalt alloys are particularly suited for electrowinning metals, such as copper, from sulfuric acid electrolytes. The cobalt-containing anodes improve the efficiency of oxygen evolution at the anode during electrowinning and reduce corrosion of the anode.

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 6 and 13 are cancelled.

Claims 1, 7 and 10-12 are determined to be patentable as amended.

Claims 2-5, 8, 9 and 14-17, dependent on an amended claim, are determined to be patentable.

New claims 18-40 are added and determined to be patentable.

1. A lead tin alloy containing greater than 0% of a member selected from the group consisting of calcium, barium, and strontium, and also containing between 0.005 and 0.300% cobalt, *0.002 to 0.10% silver*, and up to 0.035% aluminum.

7. The alloy of claim [6] *1* which additionally comprises 0.001 to 0.035% aluminum.

10. An electrowinning anode comprising a lead tin alloy containing greater than 0% of a member selected from the group consisting of calcium, barium, and strontium, and also containing between 0.005 and 0.300% cobalt, *0.002 to 0.10% silver, and up to 0.035% aluminum*.

11. [An] *The* electrowinning anode [comprising the alloy] of claim 10[containing], *wherein the alloy comprises* 0.033 to 0.10% calcium, 0.5 to 2.5% tin, and 0.005 to 0.300% cobalt.

12. [An] *The* electrowinning anode [comprising the alloy] of claim 10 [containing], *wherein the alloy comprises* 0.05 to 0.08% calcium, 1.0 to 2.2% tin, and 0.01 to 0.100% cobalt.

*18. The alloy of claim 1, wherein the alloy comprises 0.001 to 0.035% aluminum.*

*19. The alloy of claim 1, wherein the alloy comprises 1.0 to 2.5% tin.*

*20. The alloy of claim 1, wherein the alloy comprises 0.03 to 0.10% calcium.*

*21. The alloy of claim 1, wherein the alloy comprises 0.005 to 0.100% cobalt.*

*22. The electrowinning anode of claim 10, wherein the alloy comprises 0.001 to 0.035% aluminum.*

*23. The electrowinning anode of claim 10, wherein the alloy comprises 1.0 to 2.5% tin.*

*24. The electrowinning anode of claim 10, wherein the alloy comprises 0.03 to 0.10% calcium.*

*25. The electrowinning anode of claim 10, wherein the alloy comprises 0.005 to 0.100% cobalt.*

*26. The electrowinning anode of claim 10, wherein the anode comprises a rolled alloy billet having a reoriented grain structure.*

*27. An electrowinning anode comprising a rolled lead tin alloy billet having a reoriented grain structure, the alloy comprising:*

*0.03 to 0.10% calcium;*
*0.5 to 2.5% tin;*
*0.005 and 0.300% cobalt;*
*up to 0.1% silver;*
*up to 0.035% aluminum; and*
*lead and incidental impurities.*

*28. The electrowinning anode of claim 27, wherein the alloy comprises 0.002 to 0.10% silver.*

*29. The electrowinning anode of claim 27, wherein the alloy comprises 0.001 to 0.035% aluminum.*

*30. The electrowinning anode of claim 27, wherein the alloy comprises 1.0 to 2.5% tin.*

*31. The electrowinning anode of claim 27, wherein the alloy comprises 0.05 to 0.10% calcium.*

*32. The electrowinning anode of claim 27, wherein the alloy comprises 0.005 to 0.100% cobalt.*

*33. An electrowinning cell comprising:*

*an anode;*
*a cathode; and*
*an electrolyte;*
*wherein the anode comprises a lead tin alloy comprising:*
*0.03 to 0.10% calcium;*
*0.5 to 2.5% tin;*
*0.005 and 0.300% cobalt;*
*up to 0.1% silver;*
*up to 0.035% aluminum; and*
*lead and incidental impurities; and*
*wherein the anode comprises a rolled alloy billet having a reoriented grain structure.*

*34. The electrowinning cell of claim 33, wherein the alloy comprises 0.002 to 0.10% silver.*

*35. The electrowinning cell of claim 33, wherein the alloy comprises 0.001 to 0.035% aluminum.*

*36. The electrowinning cell of claim 33, wherein the alloy comprises 1.0 to 2.5% tin.*

*37. The electrowinning cell of claim 33, wherein the alloy comprises 0.03 to 0.10% calcium.*

*38. The electrowinning cell of claim 33, wherein the alloy comprises 0.005 to 0.100% cobalt.*

*39. A lead tin alloy containing between 0.01 and 0.300% cobalt, 0.05 to 0.10% calcium, 1.0 to 2.5% tin, up to 0.1% silver, and up to 0.035% aluminum.*

*40. An electrowinning anode comprising a lead tin alloy containing greater than 0% of a member selected from the group consisting of calcium, barium, and strontium, and also containing between 0.005 and 0.300% cobalt, up to 0.1% silver, and up to 0.035% aluminum, wherein the anode comprises a rolled alloy billet having a reoriented grain structure.*

* * * * *